United States Patent [19]

Johnson

[11] Patent Number: 4,711,106

[45] Date of Patent: Dec. 8, 1987

[54] LOCKING DEVICE

[76] Inventor: Clyde T. Johnson, P.O. Drawer 100, Escanaba, Mich. 49829

[21] Appl. No.: 392

[22] Filed: Dec. 31, 1986

[51] Int. Cl.[4] ..... E05B 67/36

[52] U.S. Cl. ..... 70/34

[58] Field of Search ..... 70/23, 34, 32, 33, 229, 70/232; 411/326–329, 402–403, 407–408

[56] References Cited

U.S. PATENT DOCUMENTS

| | | | |
|---|---|---|---|
| 1,444,214 | 2/1923 | Shultz . | |
| 1,491,691 | 4/1924 | Godshalk . | |
| 1,828,658 | 10/1931 | Henke, Jr. . | |
| 1,971,797 | 8/1934 | Shinn | 70/32 |
| 2,999,377 | 9/1961 | Raye | 70/32 |
| 3,139,291 | 6/1964 | Geresy . | |
| 3,605,457 | 9/1971 | Foster . | |
| 4,428,211 | 1/1984 | Hermann | 70/34 |
| 4,619,122 | 10/1986 | Simpson | 70/34 |

OTHER PUBLICATIONS

Advertising Sheet for "New Deadbolt Safety for Hi-Lo Utility Hitches", by C. T. Johnson Enterprises.

*Primary Examiner*—Robert L. Wolfe

*Attorney, Agent, or Firm*—Isaksen, Lathrop, Esch, Hart & Clark

[57] ABSTRACT

A locking device which may be used in locking two objects together, includes a stud having a threaded axial hole extending rearwardly from the forward end thereof and a keyed portion having at least one key, and a knob which locks over a forward portion of the stud and includes a casing with an inner surface including at least one keyway each of which receives the corresponding key on the stud to prevent rotation of the casing with respect to the stud. The knob also includes a tumbler housing which is mounted in an axially fixed position within the casing to rotate freely when a key is inserted into the tumbler housing, and to remain locked in a fixed position when the key is withdrawn. Connected to a rear end of the tumbler housing is a threaded stud which engages the threaded axial hole of the stud when the tumbler housing is turned by a key to thereby pull a forward portion of the stud into the casing hole.

14 Claims, 6 Drawing Figures

LOCKING DEVICE

BACKGROUND OF THE INVENTION

1. Field of the Invention

The present invention relates to locking and security devices. More specifically, the present invention relates to locking devices, which may be used to lock sway-control, weight distribution and other utility hitches for connecting vehicles, or to lock one object to another object such as a spare tire to a motor vehicle.

2. Description of the Prior Art

Various types of locking devices have been designed for a multitude of purposes. U.S. Pat. No. 3,605,457 to Foster and No. 3,139,291 to Geresy disclose trailer hitch locking devices which are used to lock a trailer hitch tongue to the ball of a conventional type of trailer hitch. Another type of device called a coupler lock has been used for locking together the central member and outer member of telescoping type utility hitches. In this type of utility hitch, the smaller central member fits telescopically into an outer member. Apertures through both members may be aligned so that a pin may be inserted therethrough to hold the central member within the outer member. If the pin is not locked onto these members in some manner it may be removed, and the vehicle which was connected to the hitch member, such as a trailer could be stolen.

Other types of locking devices have been designed for securing attachments and accessories to vehicles. The U.S. Pat. No. 1,828,658 to Henke, Jr. discloses an antitheft tire lock which utilizes band sections which wrap around a portion of the tire. U.S. Pat. No. 1,491,691 to Godshalk and No. 1,444,214 to Shultz disclose automobile spare tire locks utilizing a holding mechanism which presses against the tire rim to prevent removal of the spare tire from the vehicle. Spare tires for vehicles generally are mounted to racks affixed to the vehicle. Since tires almost uniformly have stud holes for operably connecting the tires with studs to the vehicle, it would be desirable to use the stud holes in a tire in combination with the tire rack to lock the spare tire to the vehicle.

SUMMARY OF THE INVENTION

The locking device of the present invention includes a stud having a first threaded surface and a keyed portion having at least one key and a knob which locks over a forward portion of the stud, the knob including a casing having an inner surface which defines a hole which extends axially through the casing and at least one keyway which, when the knob is placed over a forward portion of the stud, receives the corresponding key to prevent rotation of the casing with respect to the stud. The knob also includes a tumbler housing which is mounted in an axially fixed position within a forward section of the casing hole so as to rotate freely when a key is inserted into a keyhole in the tumbler housing and be locked in a fixed position when the key is withdrawn. The knob also includes a second threaded surface which is connected to a rearward end of the tumbler housing, such that, when the knob is placed over a forward portion of the stud so that the stud extends partly into a rearward section of the casing hole, rotation of the tumbler housing in one direction with the key causes a second threaded surface to engage the first threaded surface so that the forward portion of the stud is drawn into the rearward section of the casing hole. The stud of the locking device also includes a non-keyed portion which preferably may be in the form of a rod and is integrally connected to and located rearwardly of the keyed portion of the stud. Furthermore, the stud of the locking device preferably includes an expanded head which is integrally connected to and located rearwardly to the non-keyed rod portion, the expanded head being of larger diameter than the non-keyed rod portion and being similar in external form to the knob.

In the preferred locking device, which is called a locking hitch pin, the stud has a threaded axial hole extending rearwardly from the forward end of the stud which forms the first threaded surface, and the knob has an axially oriented threaded stud which is connected to the rearward end of the tumbler housing to form the second threaded surface. The keyed portion of the stud has four axially oriented keys 90° apart, and the inner surface of the casing hole has four axially oriented keyways 90° apart which are able to slidably receive the keys on the stud. When the forward portion of the stud is inserted partially into the rear section of the casing hole, the key may be used to turn the tumbler housing and connected threaded stud to thereby pull the forward portion of the stud into the rear section of the casing hole by engaging the threaded axial hole in the stud. As the forward portion of the stud is pulled into the casing hole, the keys on the keyed portion of the stud slide forwardly into the keyways on the inner surface of the knob casing. These keys and keyways have opposed mating surfaces which prevent rotation of the stud and knob with respect to each other as the forward portion of the stud moves into the casing hole and rests therewithin. Withdrawing the key from the tumbler housing allows slide tumblers to extend partially out from the tumbler housing into one of the keyways on the casing inner surface with which the slide tumblers are aligned, thereby locking the knob over the stud. When the stud includes an expanded head on the end of the non-keyed rod portion opposite the knob, the locking device may be used as a locking hitch pin for utility hitches which have telescoping central and outer members. The non-keyed rod portion may be inserted to extend through the aligned apertures in the telescoping hitching members, to thereby lock the central member within the larger outer member. This preferred embodiment of the locking device may be used to lock such hitching members together even when the central member is solid instead of hollow. The expanded head at one end of the stud and the knob at the other end of the locking hitch pin maintain the locking hitch pin within the aligned apertures of the hitching members, so that the locking hitch pin cannot be removed without a key. The locking hitch pin may also be used to lock a spare tire to the rack on which it is mounted to a vehicle. The rod portion of the stud can be inserted through a hole bored in the rack, then through one of the stud holes in the tire. The knob can then be locked over the forward portion of the stud to lock the tire in place.

Other objects, features, and advantages of the invention will be apparent with the following detailed description taken in conjunction with the accompanying drawings showing a preferred embodiment of the invention.

DESCRIPTION OF THE PREFERRED EMBODIMENT

Figure 1:
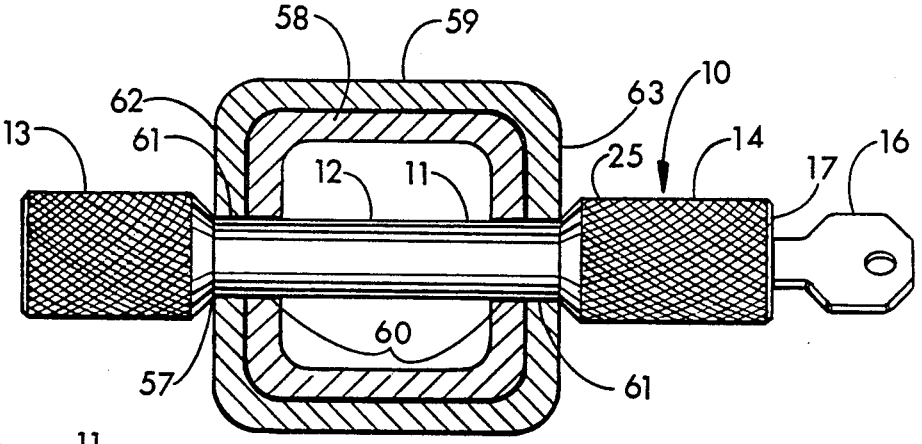
FIG. 1 is a side view of a locking hitch pin according to the present invention, shown illustratively inserted into the aligned apertures of two telescoping hitching members which are shown in cross-section.
Figure 2:
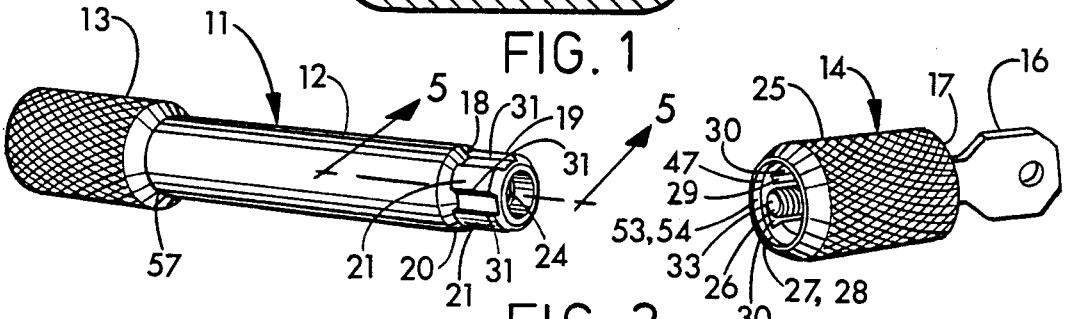
FIG. 2 is a perspective view of the locking hitch pin of FIG. 1, with the stud and knob separated from each other.
Figure 5:
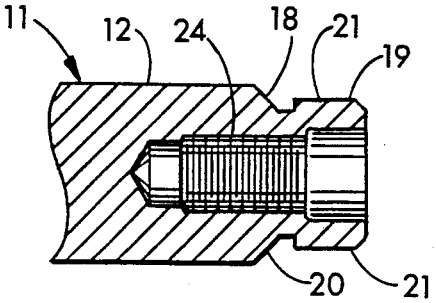
FIG. 5 is a section view taken along line 5—5 of FIG. 2.

Referring more particularly to the drawings, wherein like numbers refer to like parts, FIGS. 1 and 2 show a preferred locking device 10 which is embodied as a locking hitch pin shown generally at 10, including a stud 11 having a rod portion 12 and an expanded head 13, and a knob 14 with a locking key 16 inserted in the forward end 17 thereof. FIG. 1 shows the knob 14 locked over a forward portion 18 of the stud 11, and FIG. 2 shows the knob 14 separated from the forward portion 18 of the stud 11. The forward portion 18 of the stud 11 includes a keyed boss portion 19 of the stud 11, and the forward end 20 of the rod portion 12. When the knob 14 is locked over the forward portion 18 of the stud 11, the boss 19 and forward end 20 of the rod portion 12 are entirely contained within the knob 14. The boss 19 preferably has four axially oriented keys 21 located 90° apart. As shown in FIGS. 2 and 5, the stud 11 has a threaded axial hole 24 which forms a first threaded surface of the locking hitch pin 10.

Figure 3:
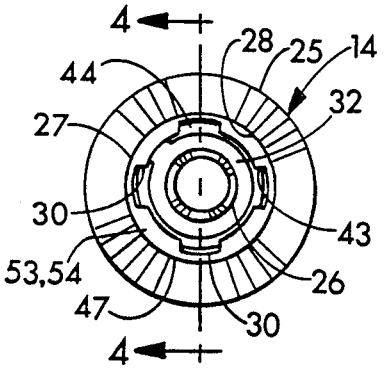
FIG. 3 is a rear view of the knob shown in FIG. 2.
Figure 4:
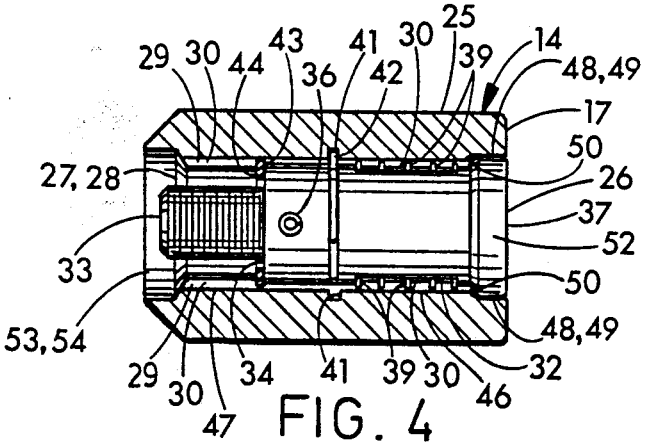
FIG. 4 is a section view taken along line 4—4 of FIG. 3, showing the tumbler housing and threaded stud in side view within the sectioned casing.

The knob 14 includes a cylindrical casing 25 and an internal mechanism 26 enclosed within a hole 27 extending axially through the casing 25, the hole 27 being defined by the inner surface 28 of the casing 25. The inner surface 28 also has four axially oriented keyways 30 located 90° apart which are adapted to receive the keys 21 on the keyed boss portion 19 of the stud 11 when the forward portion 18 of the stud 11 is inserted into the casing hole 27. These keyways 30 are shown in FIGS. 2–4. The keys 21 have mating surfaces 31 which are adapted to mate with opposed mating surfaces 29 which are on the keyways 30 of the knob 14. When each pair of opposed mating surfaces 29 and 31 abut against one another, the knob 14 and stud 11 are prevented from rotating relative to one another. For these mating surfaces 29 and 31 to prevent rotation of the knob 14 and stud 11 with respect to each other while allowing the knob and stud to slide axially with respect to each other, the surfaces should be parallel to a central axis through the knob and the stud.

Figure 6:
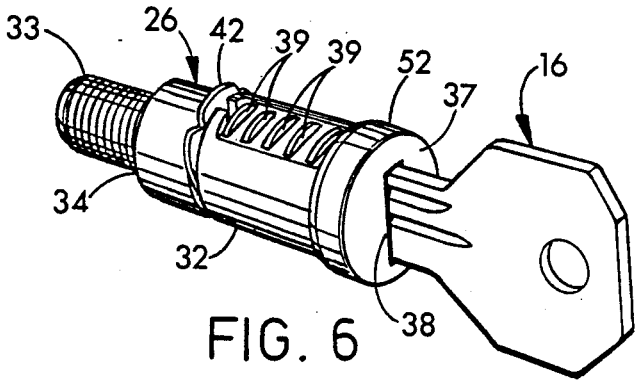
FIG. 6 is a perspective view of the tumbler housing, the threaded stud at the rear end of the tumbler housing and a key inserted into the tumbler housing keyhole.

As shown in FIGS. 4 and 6, the internal mechanism 26 of the knob 14 includes a tumbler housing 32 and a second threaded surface formed by an axially oriented threaded stud 33 which is connected to the rearward end 34 of the tumbler housing 32. In the preferred knob 14, the rearward end 34 of the tumbler housing 32 has a short threaded bore (not shown) into which the threaded stud 33 is turned. A small pin 36 is inserted through the tumbler housing 32 and threaded stud 33 to maintain the threaded stud in its position extending axially from the rearward end 34 of the tumbler housing 32. At the forward end 37 of the tumbler housing 32 is a keyhole 38 into which the key 16 may be inserted, as shown in FIG. 6. The tumbler housing 32 includes slide tumblers 39, operable by the locking key 16 which are substantially entirely contained in the tumbler housing 32 when the key 16 is fully inserted into the keyhole 38. When the key 16 is withdrawn, the slide tumblers 39 are biased to extend partially outside of the tumbler housing 32 into one of the four axially oriented keyways 30 when aligned therewith to prevent the tumbler housing 32 from rotating. Since there are four keyways 30 on the inner surface 28 of the casing 25, the tumbler housing 32 can lock into a fixed rotational position every one-quarter turn of the key 16.

In the preferred locking hitch pin 10, the inner surface 28 of the casing 25 also has an annular groove 41 as best shown in FIG. 4. The tumbler housing 32 includes a catch ring 42 which is biased to extend radially outwardly from the tumbler housing 32 as shown in FIGS. 4 and 6. This biasing of the catch ring 42 causes the ring 42 to extend from the tumbler housing 32 into the larger annular groove 41 to maintain the tumbler housing 32 in its axially fixed position. As the tumbler housing 32 is turned by the key 16, the catch ring 42 maintains its position within the larger annular groove 41 so that the tumbler housing 32 can neither move forwardly nor rearwardly from its position. Additionally, the inner surface 28 of the casing 25 has a shallow annular groove 43 which is located adjacently rearward of the tumbler housing 32 rearward end 34 as shown in FIG. 4. The knob 14 further includes an expansion ring 44 which is seated in the shallow annular groove 43 to thereby restrain the tumbler housing 32 against any rearward movement thereof as shown in both FIGS. 3 and 4. In the preferred locking hitch pin 10, this expansion ring 44 within the casing hole 27 divides that hole 27 into a forward section 46 where the tumbler housing 32 fits, and a rearward section 47 into which the threaded stud 33 extends and which is adapted to receive the forward portion 18 of the stud 11.

The forward end 48 of the casing hole 27 is preferably widened to form a forward sheath 49 and a radial retention surface 50 which faces in a forward direction. A forward end 37 of the tumbler housing 32 is also widened to form a flange 52 which has an outside diameter which is slightly smaller than the inside diameter of the forward sheath 49 so that the flange 52 fits snuggly within the forward sheath 49 when the tumbler housing 32 is properly positioned within the forward section 46 of the casing hole 27. The fit must not be so tight that the tumbler housing 32 cannot rotate within the casing 25. When the flange 52 is seated within the forward sheath 49, the flange 52 should obscure the keyways 30 and the casing hole 27 so that they cannot be pried. In order for the keyways 30 to be obscured, they cannot extend into the forward sheath 49. Therefore, the forward end 48 of the casing hole 27 which forms the forward sheath 49 must be widened to an extent which is at least as far outward radially as the radially outermost extent of the keyways 30, i.e. that point within the keyways 30 which is radially furthest from the central axis of the casing 25 and casing hole 27. The forward sheath 49 should extend rearwardly within the casing hole 27 to a point where the radial retention surface 50 abuts against the flange 52 to provide further restraint against the tumbler housing 32 moving rearwardly, but such that the forward end 37 of the tumbler housing 32 is flush with the forward end 17 of the knob 14.

The rearward end 53 of the casing hole 27 is also preferably widened to form a rearward sheath 54 which is adapted to receive the forward end 20 of the non-keyed rod portion 12 when the forward portion 18 of the stud 11 is fully inserted within the rearward section 47 of the casing hole 27. The non-keyed rod portion 12 therefore preferably has an outer diameter which is slightly smaller than the inside diameter of the rearward sheath 54 so that the non-keyed portion 12 seats snuggly within the rearward sheath 54 when the forward portion 18 of the stud 11 is drawn into the rearward section 47 of the casing hole 27. The forward end 20 of the non-keyed rod portion 12 should seat within the rearward sheath 54 so as to obscure the casing hole 27 and keyways 30. For the non-keyed portion 12 of the stud 11 to obscure the keyways 30, the keyways 30 in the inner surface 28 of the casing 25 cannot extend into the rearward sheath 54. Therefore to form the rearward sheath 54, the rearward end 53 of the casing hole 27 must be widened to an extent at least as far outward radially as the radially outermost extent of the keyways 30. Since the non-keyed portion 12 of the stud 11 seats snuggly within the rearward sheath 54, neither the casing hole 27 nor the keyways 30 may be pried from the outside. The rearward end 55 of the casing 25 is tapered rearwardly and radially inwardly to the rearward end 53 of the casing hole 27, so that when the forward end 20 of the non-keyed rod portion 12 of the stud 11 is drawn into the rearward sheath 54, the tapered rearward end 55 of the casing 25 inhibits use of that end to pry the knob 14 away from the stud 11.

FIGS. 1–6 are an exemplification of the invention, and are not intended to limit the embodiments of the invention to that shown. The non-keyed portion 12 of the stud 11 may vary both in length and diameter, and the stud 11 need not include an expanded head 13. Although the non-keyed portion 12 shown in FIG. 1 is a rod portion which is integrally connected to and located rearwardly of the keyed portion 19, alternatively the non-keyed portion even could be so short as to not resemble a rod. For example, in one embodiment the locking device could be used for locking and holding a panel cover to an electrical control box. In such a case, the stud 11 would have no expanded head 13, and the non-keyed portion 12 might be very short and connected by its rearward end 57 to the control box by a weld. Such an electrical control box could have a plurality of these locking devices for locking and holding a cover panel thereon. The cover panel would have holes that would receive the non-keyed portions 12 of the studs 11 when the cover panel is placed over the electrical control box opening. After the cover panel is properly placed, the knobs 14 could then be locked over the studs 11 to hold and lock the cover panel to the control box. In another embodiment, a shorter version of the locking hitch pin 10 shown in FIG. 1, could be used for locking spare tires to the rack in which they are placed on a motor vehicle. The locking device also could be used for locking scaffolding together and for locking various other types of equipment and apparatus together.

The keyed portion 19 of the stud 11 also need not be a boss 19. Instead the keys 21 on the keyed portion 19 could extend radially outward from the axis of the stud 11 as far as the surface of the non-keyed rod portion 12. In such a case, the keyed portion 19 would not have the appearance of a boss, because at least where the keys 21 were, the keyed portion would have the same outside radius as the non-keyed rod portion 12. Furthermore, an alternative embodiment of the locking device 10 may have mating surfaces on the stud 11 and knob 14 which take a form other than keys 21 and keyways 30.

In its use, the locking device 10 is intended to be used for locking two or more pieces of equipment, apparatus, or objects together, such as a trailer to a towing vehicle. When used with a weight distribution hitch, sway control trailer hitch or a Hi-Lo Utility hitch, before attempting to insert the stud 11 the user should make sure that the central member 58 of the hitch is properly inserted into the outer member 59 so that the apertures 60 and 61 are properly aligned with one another as shown in FIG. 1. The stud 11 may then be inserted into the apertures 60 and 61 so that the keyed portion 19 extends out from the apertures 60 and 61 to the side 63 opposite to that side 62 in which the stud 11 was inserted. While holding the stud 11 by its expanded head 13 so the stud 11 does not come out of the apertures 60 and 61, the user may place the knob 14 over the keyed portion 19 or boss, so that the forward portion 18 of the stud 11 extends partly into the rearward section 47 of the casing hole 27. Turning the key 16 clockwise will cause the threaded stud 33 to engage the threaded axial hole 24, thereby drawing the forward portion 18 of the stud 11 fully into the rearward section 47 of the casing hole 27. As the key 16 is turned, only the tumbler housing 32 and threaded stud 33 which comprise the internal mechanism 26 rotate within the casing 25. Neither the casing 25 nor the stud 11 rotate as the key 16 is turned. Every one-quarter turn of the key 16 causes the slide tumblers 39 to be aligned with one of the four keyways 30 within the casing hole 27. When so aligned, the key 16 may be withdrawn and the tumbler housing 32 locked into position. Without the key 16, the knob 14 cannot be removed from the stud 11. Re-inserting the key 16 and turning the key 16 counterclockwise until the threaded stud 33 and threaded axial hole 24 disengage removes the knob 14 from the stud 11. In other applications of the present invention, the knob 14 is locked to the stud 11 in much the same manner as described above.

The locking hitch pin 10 shown in FIG. 1 may be also used with trailer hitching systems where the central member 58 is solid instead of hollow. Once in place, the locking hitch pin 10 according to the present invention is very difficult to pry open or to otherwise improperly remove. All surfaces on the locking device which might be vulnerable to prying are obscured or tapered to remove prying or pivoting points.

It is to be understood that the present invention is not limited to the particular arrangement and embodiments of the parts disclosed and illustrated herein, but embraces all such modified forms thereof as come within the scope of the following claims.

What is claimed is:

1. A locking device comprising:

(a) a stud including a first threaded surface and a keyed portion having at least one key; and (b) a knob which locks over a forward portion of the stud, including (i) a casing having an inner surface which defines a hole and at least one keyway extending axially through the casing such that when the knob is placed over a forward portion of the stud, each keyway receives the corresponding key on the stud to prevent rotation of the casing with respect to the stud;

(ii) a tumbler housing which is mounted in an axially fixed position within a forward section of the casing hole, the tumbler housing including a plurality of locking key-operated slide tumblers which are substantially contained within the housing to permit rotation of the housing within the casing, and which are operatively extendable outside of the housing to engage a said keyway in the casing to prevent rotation of the housing within the casing; and (iii) a second threaded surface connected to a rearward end of the tumbler housing such that when the knob is placed over a forward portion of the stud rotation of the tumbler housing in one direction causes the second threaded surface to engage the first threaded surface of the stud so that the forward portion of the stud is drawn into the rearward section of the casing hole.

2. The locking device of claim 1 wherein the inner surface of the casing further includes a larger annular groove; and wherein the tumbler housing includes a catch ring which is biased to extend radially outwardly from the tumbler housing into the larger annular groove to maintain the tumbler housing in its axially fixed position.

3. The locking device of claim 1 wherein the inner surface of the casing defines a shallow annular groove which is located adjacently rearward of the tumbler housing rearward end; and wherein the knob further includes an expansion ring which is seated in the shallow annular groove to restrain the tumbler housing against any rearward movement thereof and to divide the hole into a rearward and a forward section.

4. A locking device comprising:

(a) a stud including a first threaded surface and a keyed portion having at least one key; and (b) a knob which locks over a forward portion of the stud, including (i) a casing having an inner surface which defines a hole extending axially through the casing and at least one keyway such that when the knob is placed over a forward portion of the stud, each keyway receives the corresponding key on the stud to prevent rotation of the casing with respect to the stud;

(ii) a tumbler housing which is mounted in an axially fixed position within a forward section of the casing hole to rotate freely when a key is inserted into a a keyhole in the tumbler housing, and to remain locked in a fixed position when the key is withdrawn; and (iii) a second threaded surface connected to a rearward end of the tumbler housing such that when the knob is placed over a forward portion of the stud so that the stud extends partly into a rearward section of the casing hole, rotation of the tumbler housing in one direction causes the second threaded surface to engage the first threaded surface so that the forward portion of the stud is drawn into the rearward section of the casing hole;

wherein a forward end of the casing hole is widened at least as far radially outward as a radially outermost extent of the keyways to form a forward sheath in which the keyways are absent and a radial retention surface which faces in a forward direction; and wherein a forward end of the tumbler housing is widened to form a flange which has an outside diameter slightly less than an inside diameter of the forward sheath, so that when the tumbler housing is positioned within the casing hole, the flange fits snuggly within the forward sheath to obscure the keyways and casing hole, and the radial retention surface abuts against the flange to restrain the tumbler housing from rearward movement.

5. The locking device of claim 1 wherein the stud has a threaded axial hole which forms the first threaded surface, and the knob has an axially oriented threaded stud which is connected to the rearward end of the tumbler housing to form the second threaded surface.

6. The locking device of claim 1 wherein there are four axially oriented keys about ninety degrees apart on the keyed portion of the stud, and wherein the inner surface of the casing hole defines four axially oriented keyways about ninety degrees apart for receiving the keys on the stud.

7. A locking device comprising:

(a) a stud including a first threaded surface and a keyed portion having at least one key; and (b) a knob which locks over a forward portion of the stud, including (i) a casing having an inner surface which defines a hole extending axially through the casing and at least one keyway such that when the knob is placed over a forward portion of the stud, each keyway receives the corresponding key on the stud to prevent rotation of the casing with respect to the stud;

(ii) a tumbler housing which is mounted in an axially fixed position within a forward section of the casing hole to rotate freely when a key is inserted into a a keyhole in the tumbler housing, and to remain locked in a fixed position when the key is withdrawn; and (iii) a second threaded surface connected to a rearward end of the tumbler housing such that when the knob is placed over a forward portion of the stud so that the stud extends partly into a rearward section of the casing hole, rotation of the tumbler housing in one direction causes the second threaded surface to engage the first threaded surface so that the forward portion of the stud is drawn into the rearward section of the casing hole;

wherein a rearward end of the casing hole is widened at least as far radially outward as a radially outermost extent of the keyways to form a rearward sheath in which the keyways are absent; and wherein the stud includes a non-keyed portion which is integrally connected with and located rearwardly of the keyed portion of the stud, and wherein the non-keyed portion is of slightly smaller outside diameter than an inside diameter of the rearward sheath so that when the forward portion of the stud is drawn into a rearward section of the casing hole, the forward end of the non-keyed portion of the stud seats snuggly within the rearward sheath and obscures the casing hole and keyways.

8. The locking device of claim 7 wherein a rearward end of the casing is tapered rearwardly and radially inwardly to the widened rearward end of the casing hole, so that when the forward end of the non-keyed portion of the stud is drawn into the rearward sheath, the knob lacks any surface which could easily be used to pry the knob from the stud.

9. The locking device of claim 7 wherein the non-keyed portion comprises a rod portion which is integrally connected to and located rearwardly of the keyed portion, the rod portion having a diameter which is slightly smaller than the inside diameter of the rearward sheath.

10. The locking device of claim 9 wherein the stud further includes an expanded head which is integrally connected to and located rearwardly of the rod portion, the expanded head being of larger diameter than the rod portion and being similar in external form to the knob.

11. A locking hitch pin, comprising:

(a) a stud including (i) a keyed portion having at least one key and a forward end;

(ii) a non-keyed rod portion which is integrally connected to and located rearward to the keyed portion;

(iii) an expanded head which is integrally connected to and located rearwardly of the non-keyed rod portion; and (iv) a threaded surface which defines a threaded bore extending rearwardly from the forward end of the keyed portion;

(b) a knob which locks over a forward portion of the stud, the knob including (i) a casing including an inner surface which defines a hole extending axially through the casing and at least one keyway such that when the knob is placed over a forward portion of the stud, each keyway receives the corresponding key to prevent rotation of the casing with respect to the stud;

(ii) an internal mechanism which is rotatably mounted within the casing hole in an axially fixed position, the internal mechanism including a threaded stud extending axially rearwardly so that when the forward portion of the stud is inserted into the casing hole and the internal mechanism is rotated, the threaded stud engages the threaded bore to draw the forward portion of the stud into a rearward section of the casing hole; and (c) means for locking the forward portion of the stud in the casing hole;

wherein a forward end of the casing hole is widened at least as far radially outward as a radially outermost extent of the keyways to form a forward sheath in which the keyways are absent, and a radial retention surface which faces in a forward direction; and wherein a forward end of the internal mechanism is widened to form a flange which has an outside diameter slightly smaller than an inside diameter of the forward sheath, so that when the internal mechanism is properly positioned within the casing hole, the flange fits snuggly within the forward sheath to obscure the keyways and casing hole, and the radial retention surface abuts against the flange to restrain the internal mechanism from rearward movement.

12. A locking hitch pin, comprising:

(a) a stud including (i) a keyed portion having at least one key and a forward end;

(ii) a non-keyed rod portion which is integrally connected to and located rearward to the keyed portion;

(iii) an expanded head which is integrally connected to and located rearwardly of the non-keyed rod portion; and (iv) a threaded surface which defines a threaded bore extending rearwardly from the forward end of the keyed portion;

(b) a knob which locks over a forward portion of the stud, the knob including (i) a casing including an inner surface which defines a hole extending axially through the casing and at least one keyway such that when the knob is placed over a forward portion of the stud, each keyway receives the corresponding key to prevent rotation of the casing with respect to the stud;

(ii) an internal mechanism which is rotatably mounted within the casing hole in an axially fixed position, the internal mechanism including a threaded stud extending axially rearwardly so that when the forward portion of the stud is inserted into the casing hole and the internal mechanism is rotated, the threaded stud engages the threaded bore to draw the forward portion of the stud into a rearward section of the casing hole; and (c) means for locking the forward portion of the stud in the casing hole;

wherein a rearward end of the casing hole is widened to an extent at least as far radially outward as a radially outermost extent of the keyways to form a rearward sheath in which the keyways are absent; and wherein the non-keyed rod portion of the stud has an outside diameter which is slightly less than an inside diameter of the rearward sheath so that when the forward portion of the stud is drawn into a rearward section of the casing hole, a forward end of the non-keyed portion of the stud seats snuggly within the rearward sheath and obscures the casing hole and keyways.

13. A locking hitch pin, comprising:

a stud including a boss having a forward end;

a rod portion integrally connected to and located rearwardly of the boss; and an expanded heat which is integrally connected to and located rearwardly of the rod portion;

a knob which locks over a forward portion of the stud, the knob including a casing having an inner surface defining a hole therethrough;

at least one set of opposed mating surfaces which are parallel to a central axis through the knob and the stud, wherein one surface of each set is on the boss and the other is on the knob, the surfaces mating to prevent rotation of the stud and knob with respect to each other when the forward portion of the stud moves into the casing hole and rests therewithin;

two engaging threaded surfaces, one on the stud and one on the knob such that when the knob is placed over the forward portion of the stud so that the stud extends partly into a rearward section of the casing hole, one of the threaded surfaces can be turned to engage the other threaded surface and pull the forward portion of the stud into the rearward section of the casing hole; and means for locking the forward portion of the stud within the rearward section of the casing hole;

wherein the threaded surface on the stud is defined by a threaded bore extending rearwardly from the forward end of the boss;

wherein the knob further includes a tumbler housing which is rotatably mounted within the casing hole in an axially fixed position, the threaded surface on the knob being defined by a threaded stud which extends axially rearwardly from a rearward end of the tumbler housing;

wherein the boss includes a plurality of keys and the inner surface of the casing defines a plurality of keyways which are sized to receive the keys when the forward portion of the stud moves into the casing hole and rests therewith, the keys and keyways forming the sets of opposed mating surfaces which prevent relative rotation of the knob and stud, wherein a forward end of the casing hole is widened at least as for radially outward as a radially outermost extent of the keyways to form a forward sheath in which the keyways are absent and a radial retention surface which faces in a forward direction;

wherein a forward end of the tumbler housing is widened to form a flange which has an outside diameter slightly less than an inside diameter of the forward sheath, so that when the tumbler housing is positioned within the casing hole, the flange fits snuggly within the forward sheath to obscure the keyways and casing hole, and the radial retention surface abuts against the flange to restrain the tumbler housing from rearward movement.

14. A locking hitch pin, comprising:

a stud including a boss having a forward end;

a rod portion integrally connected to and located rearwardly of the boss; and an expanded head which is integrally connected to and located rearwardly of the rod portion;

a knob which locks over a forward portion of the stud, the knob including a casing having an inner surface defining a hole therethrough;

at least one set of opposed mating surfaces which are parallel to a central axis through the knob and the stud, wherein one surface of each set is on the boss and the other is on the knob, the surfaces mating to prevent rotation of the stud and knob with respect to each other when the forward portion of the stud moves into the casing hole and rests therewithin;

two engaging threaded surfaces, one on the stud and one on the knob such that when the knob is placed over the forward portion of the stud so that the stud extends partly into a rearward section of the casing hole, one of the threaded surfaces can be turned to engage the other threaded surface and pull the forward portion of the stud into the rearward section of the casing hole; and means for locking the forward portion of the stud within the rearward section of the casing hole;

wherein the threaded surface on the stud is defined by a threaded bore extending rearwardly from the forward end of the boss;

wherein the knob further includes a tumbler housing which is rotatably mounted within the casing hole in an axially fixed position, the threaded surface on the knob being defined by a threaded stud which extends axially rearwardly from a rearward end of the tumbler housing;

wherein the boss includes a plurality of keys and the inner surface of the casing defines a plurality of keyways which are sized to receive the keys when the forward portion of the stud moves into the casing hole and rests therewithin, the keys and keyways forming the sets of opposed mating surfaces which prevent relative rotation of the knob and stud;

wherein a rearward end of the casing hole is widened at least as far radially outward as a radially outermost extent of the keyways to form a rearward sheath in which the keyways are absent; and wherein the rod portion of the stud, to the rear of the keyed boss, has an outside diameter which is slightly smaller than an inside diameter of the rearward sheath so that when the forward portion of the stud is drawn into a rearward section of the casing hole, a forward end of the rod portion seats snuggly within the rearward sheath to obscure the casing hole and keyways.

* * * * *